United States Patent [19]

Tenner et al.

[11] 4,357,511

[45] Nov. 2, 1982

[54] MODULAR PUSH-BUTTON SWITCH WITH LIGHTED PUSH-BUTTON ELEMENT

[75] Inventors: Richard B. Tenner, Oak Creek; Robert G. Bracey, Germantown, both of Wis.

[73] Assignee: Eaton Corporation, Cleveland, Ohio

[21] Appl. No.: 299,440

[22] Filed: Sep. 4, 1981

[51] Int. Cl.[3] ..... H01H 9/18

[52] U.S. Cl. ..... 200/314; 200/153 J; 200/67 G

[58] Field of Search ..... 200/314, 310, 153 J, 200/67 G, 68

[56] References Cited

U.S. PATENT DOCUMENTS

| | | | |
|---|---|---|---|
| 3,183,333 | 5/1965 | Golbeck | 200/314 |
| 3,521,013 | 7/1970 | Gaumanis | 200/314 |
| 3,602,678 | 8/1971 | Laete | 200/314 |
| 3,789,173 | 1/1974 | Bury | 200/153 J |
| 3,867,596 | 2/1975 | Schadow | 200/153 J |
| 3,927,290 | 12/1975 | Denley | 200/314 |
| 3,988,557 | 10/1976 | Francke et al. | 200/314 |
| 4,095,070 | 6/1978 | Simpson | 200/153 J |
| 4,115,673 | 9/1978 | Smith | 200/315 |
| 4,161,637 | 7/1979 | Priesemuth | 200/153 J |
| 4,172,973 | 10/1979 | Sano | 200/315 |

*Primary Examiner*—John W. Shepperd

*Attorney, Agent, or Firm*—C. H. Grace; F. M. Sajovec

[57] ABSTRACT

A push-button switch having two main subassemblies comprising an operator subassembly (2) and a housing subassembly (4) which are snap-fit together. A light emitting diode (10) is mounted flush in the center of the exterior face of the pushbutton (6) with the diode leads (10*a*) extending through the center of the switch mechanism to engage lamp contacts (20) at the rear of the switch housing (18). The switch contacts (22, 24, 26, 28) and mechanism are arranged to lie on opposite sides of center and are provided with various central clearance openings (8*b*, 16*a*, 30*b*) to permit the leads (10*a*) to project in an unsupported manner axially to the lamp contacts (20). The switch contacts comprise rockable contactors (28, 32) pivotable on a central contact (24, 34) to engage stationary contacts (22, 26) on either side thereof either alternately or as a momentary contact function.

17 Claims, 5 Drawing Figures

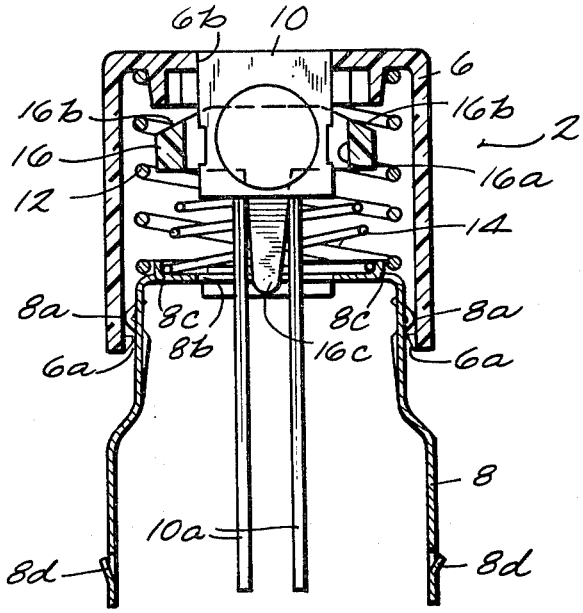
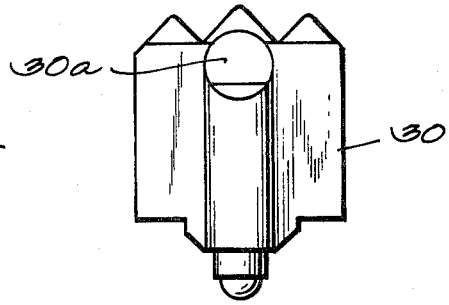
Fig. 1
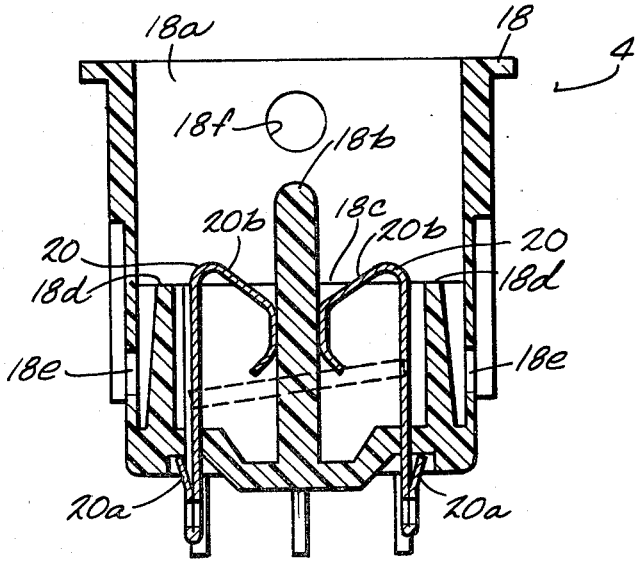

MODULAR PUSH-BUTTON SWITCH WITH LIGHTED PUSH-BUTTON ELEMENT

BACKGROUND OF THE INVENTION

It is a common practice in electric switches to utilize lamps as indicators of switch location, function or of some circuit condition of the switch contacts. A preferred method of accomplishing this is to mount the lamp in the switch operator element. Inasmuch as the operator element is normally a moving member, a problem exists in providing electrical connection to the lamp. In designs where lamps having metallic bases are used, formed terminal members are provided which have a hinge or brush electrical connection with the moving lamp. A trend towards miniaturization of switches and lamps alike has produced incandescent lamp bulbs having no metallic base, but thin wire leads extending therefrom. The size of such lamps facilitates their use in switch operators, but the fragility of the lamp leads requires particular design attention to the commutation means for conducting electrical current to these leads. One method has been to provide conducting sleeves over the leads to increase their rigidity while other methods provide helical springs to bear against the leads and make electrical contact therewith. The latter approach provides "dry circuit" conditions which are susceptible to contamination and circuit failure, while the added sleeve approach requires the production and assembly of additional separate parts to the switch, thereby increasing the manufacturing cost thereof.

The introduction of solid state lamp devices such as light emitting diodes has generated new approaches to the methods of providing electrical connections thereto in view of the more substantial and more rigid electrical leads of such diodes. U.S. Pat. No. 4,115,673 uses a light emitting diode in a rocker button and causes the relatively short but unsupported leads of the diode to move into or out of engagement with upstanding contact members on the switch itself to make electrical connection to the lead when the switch is moved to one position and to break that electrical connection when the switch rocker is moved to its opposite position.

Push-button switches have particular problems and concerns when providing commutation to button-mounted lamp devices and the leads therefore. One particular consideration is that the distance between lamp contacts and the lamp is significantly increased because of the need for additional switch mechanism between the contact actuator and the operator. Another concern is the location of the lamp element on the face of the button and the ability to route the lamp leads through the switch body without adversely effecting the switch mechanism.

SUMMARY OF THE INVENTION

This invention provides a push-button switch having a light emitting diode as a lamp element mounted centrally in the face of the button element and having the lamp leads extend axially through the switch mechanism to lamp contacts located in the lower or innermost portion of the switch housing. The lamp leads are unsupported by extra members and the switch mechanism is provided with central openings to provide clearance for the lamp leads. The switch is further designed to present a fully insulated exterior and snap together modular construction.

BRIEF DESCRIPTION OF THE DRAWINGS

FIG. 1 is a longitudinal cross-sectional view of the push-button switch of this invention showing the switch disassembled into two major subassemblies, and having a contact actuator removed from the lower assembly;

DESCRIPTION OF THE PREFERRED EMBODIMENT

Figure 3:
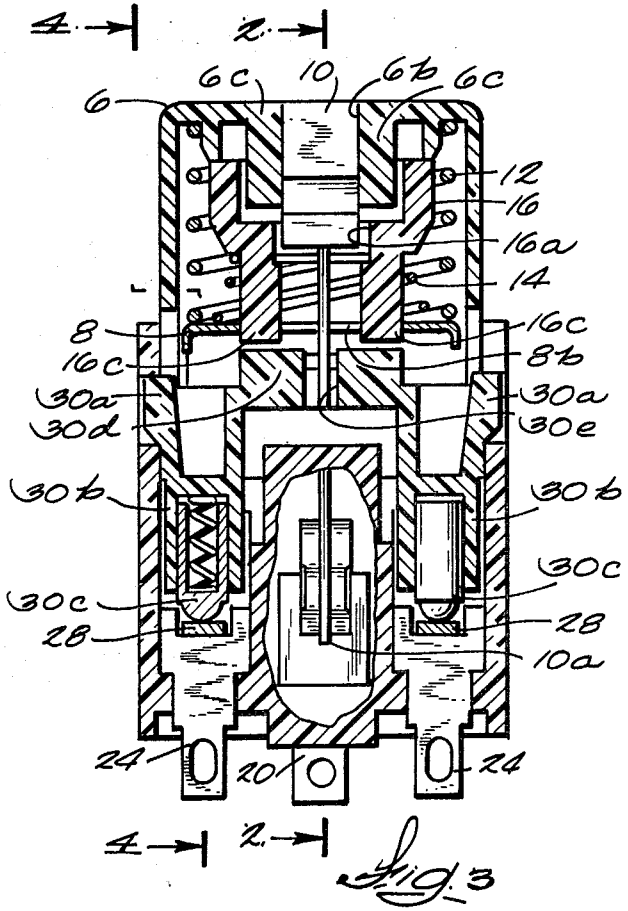
FIG. 3 is a longitudinal sectional view of the switch taken generally along the line 3—3 of FIG. 2 and having a portion broken away to show lamp terminal configuration.

The switch as shown in FIG. 1 comprises two major subassemblies; an operator subassembly 2 and a housing subassembly 4. Operator subassembly 2 comprises a molded insulating button element 6 snap-fit to a formed metal retainer 8 by the cooperation of projections **6*a* formed on the lower end of the button and resilient tabs 8*a* formed in the sides of retainer 8. Tabs 8*a* are sheared from the material forming the sides of the retainer 8 and then are formed to present outwardly extending cam surfaces which are cammed inwardly upon insertion of the button 6 over the end of the retainer 8 and then snap outwardly behind the projections 6*a* after the latter have cleared the cam formations. Button 6 is also provided with a central opening 6*b* which can be seen in FIG. 3 to be flanked by depending projections 6*c* on one pair of opposite sides thereof. A lamp element such as a light emitting diode 10 is mounted within the opening 6*b*, preferably by an interference fit with such opening, to be flush with the exterior surface of button 6. Lamp 10 has a pair of electrical leads 10*a* depending from the lower surface thereof and extending through a central opening 8*b* in the retainer 8. Leads 10*a* are solid conductors of sufficient cross-sectional area to enable them to withstand longitudinal distortion under moderate compressive forces and depend from the diode 10 in an otherwise unsupported manner. A first helical compression spring 12 is positioned between the button 6 and the retainer 8 to bias the button to its outermost position with respect to the retainer as determined by the engagement of projections 6*a* and tabs 8*a*. Button 6 is provided with a rearwardly extending circular ridge which serves to position the upper end of spring 12 while the retainer 8 has a plurality of tabs 8*c* struck therefrom and formed upwardly to position the lower end of spring 12 as well as to position a second compression spring 14. Spring 14 bears upon the lower surface of a driver member 16. Driver 16 has a central opening 16*a* in which lamp 10 is disposed, a substantially flat upper surface which is biased into engagement with the end of button 6, and beveled surfaces 16*b* at its outer edges as seen particularly in FIGS. 1 and 2. The lower surface of driver 16 is provided with a pair of depending driver pawls 16*c* which extend axially on opposite sides of the opening 16*a* as seen particularly in FIG. 3. The pawls 16***c* also project through the opening 8*b* of retainer 8.

The housing subassembly 4 comprises an insulating housing 18 which has a cavity 18*a* open to the upper end thereof and a plurality of upstanding walls formed at the bottom end thereof. A first upstanding wall 18*b* separates a pair of lamp terminals 20 which are pressed into openings in the bottom wall of housing 18 and retained in place by tangs 20*a* at the exterior terminal ends of the contacts 20. Contacts 20 have reflex formed contact fingers 20*b* which resiliently engage the wall 18*b* and extend rearwardly therealong toward the bottom wall. A pair of transverse walls 18*c* (only one of which is shown) separate the central compartment in which lamp terminals 20 are mounted from a pair of outer compartments in which the switch contacts are mounted as will be described hereinafter. On opposite sides of the contacts 20 a further pair of upstanding walls 18*d* are formed which have upwardly diverging angular surfaces to create pockets between the walls 18*d* and the exterior side walls of the housing 18. Openings 18*e* are formed in the housing side walls in the area of the pockets formed in conjunction with walls 18*d*, the openings 18*e* cooperating with sheared outwardly formed tabs 8*d* on retainer 8 to provide snap-in attachment of the depending legs of retainer 8 and thus the operator subassembly 2 to the housing subassembly 4.

Figure 4:
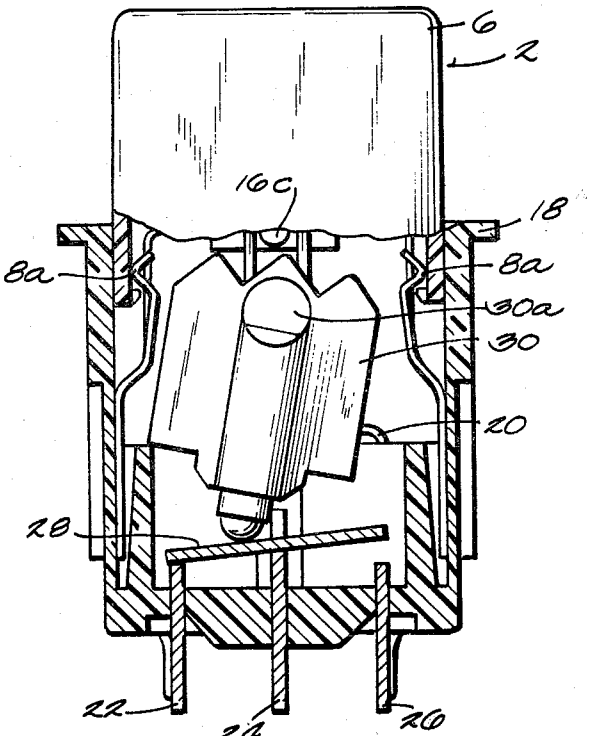
FIG. 4 is a sectional view taken generally along the line 4—4 in FIG. 3 showing one of the switch poles of the switch.

Referring specifically to FIGS. 3 and 4, the outer compartments of housing 18 contain three stationary contacts 22, 24 and 26, which are preferably press-fit into openings in the bottom wall of the housing 18. Center contact 24 may be seen to extend slightly higher within the compartment than the outer contacts 22 and 26, and has pivotly mounted thereon a rockable bridging contactor 28. A contact actuator 30 has a pair of trunions 30*a* formed at opposite sides thereof to pivotly mount the actuator 30 in openings 18*f* of housing 18. The lower edges of trunions 30*a* are beveled inwardly to cam the sides of housing 18 outwardly as the actuator is pressed into the housing, thereby enabling actuator 30 to be snapped into the housing for assembly. As seen particularly in FIG. 3, actuator 30 has a pair of outer depending portions having cylindrical bores therein to receive spring loaded plungers 30*c* which bear upon the upper surfaces of contactors 28. The portions 30*b* are joined along their upper ends by a central web 30*d* which has a W-cam surface on the upper surface thereof and a central opening 30*e* extending therethrough.

Figure 2:
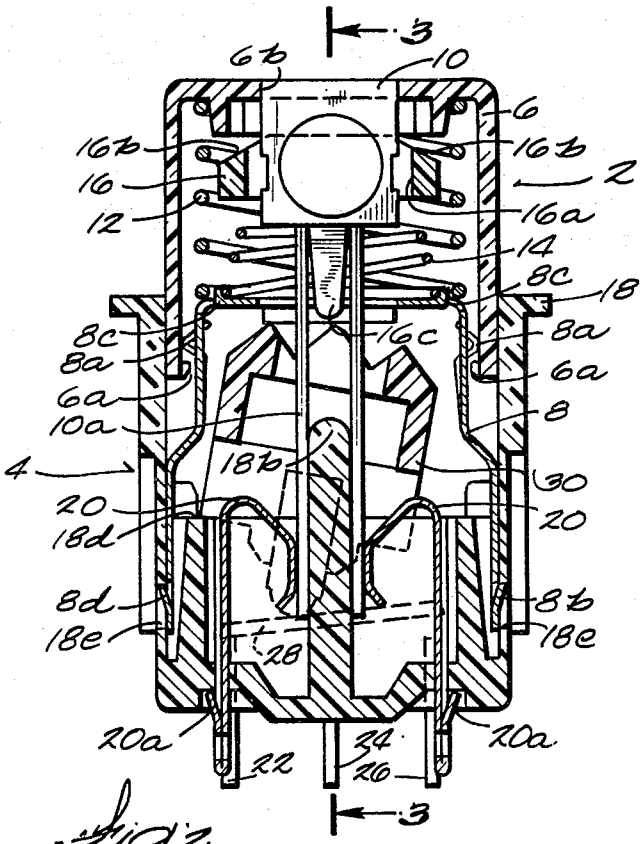
FIG. 2 is a longitudinal sectional view of the switch taken generally along the line 2—2 in FIG. 3 and being similar to the sectional view shown in FIG. 1, but showing the switch in its assembled condition.

The completed switch is assembled by inserting the operator subassembly 2 into the housing subassembly 4, such that the depending legs of frame 8 fit between walls 18*d* and the housing sidewalls, until the tangs 8*d* snap into the openings 18*e*. This insertion also causes lamp leads 10*a* to project rearwardly through the opening 30*e* in actuator 30 and engage the contact fingers 20*b* of lamp contacts 20*a* to slide between these fingers and the upstanding wall 18*b* of the housing 18. As seen in FIG. 2 the lamp leads 10*a* are in engagement with the fingers 20*b* when the button 6 is in its outwardly extended position. Accordingly, the lamp 10 is electrically connected to the lamp contacts 20 at all times and may be used as an indicator of a function which is not necessarily related to the switch contacts. However, suitable connections between the switch contacts and the lamp terminals 20 provides the ability of the lamp to be used as an indication of switch position or switch contact conditions.

Referring to FIG. 2, it may be seen that the driver pawls 16*c* lie above and out of engagement with the W-cam surface of actuator 30 when button 6 is in its fully extended position. The actuator 30 is initially pivoted to one side of center by virtue of an engagement of plungers 30*c* with the contactor 28 which establish an over center condition for the switch contacts. In this position the apex of the W-cam surface lies to one side of the driver pawl 16*c*. Depression of the pushbutton moves the driver 16 inwardly such that pawl 16*c* engages the sloped surface of the W-cam at the left-hand side of the apex and continued inward movement pivots the actuator in a counter-clockwise direction about the trunions 30*a* to cause plungers 30*c* to traverse the surface of contactors 28 over-center of the central contact 24 and actuate the switch contacts to their opposite position. The engagement of driver pawl 16*c* with the W-cam surface rocks the driver at its upper surface on the button 6 by virtue of the apecies formed by the upper surface on the driver and the beveled outer surfaces 16*b* thereof and the resilient mounting of the driver in the button by spring 14. When released, the button 6 is urged outwardly by virtue of return spring 12 and the pawls 16*c* disengage the W-cam surface of the actuator 30, thereby permitting the driver to be squarely repositioned on the button by virtue of its flat upper surface. The complete operation of depression and release of the pushbutton thereby causes the actuator 30 to assume the reverse angular position from that shown in FIG. 2 whereby the apex of the W-cam now lies to the left of the driver pawl 16*c*. A subsequent operation, i.e., depression and release of the pushbutton, will rotate the actuator in a clockwise direction to actuate the switch contacts to their original position as shown in FIG. 2. Thus the switch described is a push-push switch which operates the contacts to alternate positions upon subsequent operations of the pushbutton.

Figure 5:
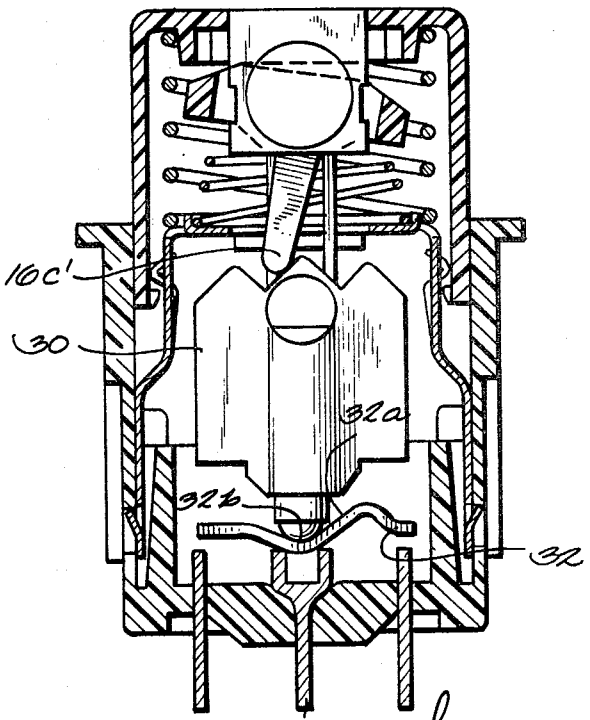
FIG. 5 is a view similar to FIG. 4 but showing a modified version thereof.

An alternate version of switch is shown in FIG. 5 wherein a modified contactor 32 is provided with a sloped surface 32*a* at one side of center and a central valley 32*b* which is situated in a cradle form by tral contact 34. The biasing action of the spring biased plungers 30*c* maintain the actuator 30 in and axially aligned position when the button 6 is in its extended position. It may also be seen in this figure that driver has somewhat longer pawls 16*c*′ which are continuously in engagement with the cam surface of actuator 30 and that the driver is continuously in an angular position with respect to the button. Depression of the button in this version rotates the actuator 30 counter-clockwise about the trunions 30*a* causing the plungers 30*c* to ride up on the angular surface 32*a* of the contactor 32 thereby rocking the contactor into engagement with the right-hand contact 26. When so engaged the angular surface still presents a central bias through the spring biased plungers 30*c* to the actuator 30 so that when the button is released and permitted to extend the plungers 30*c* return the actuator to the central position as shown in FIG. 5. In this manner a momentary contact switch has been provided.

Referring again to FIGS. 2 and 3, it may be seen that the lamp leads 10*a* are in continuous contact with contact fingers 20*b* and that depression of the button 6 causes the lamp leads to move axially inward along the guiding wall 18*b* to be in sliding contact with fingers 20*b*. The centralized location of the lamp leads and the axial alignment and travel thereof create no undue side forces on the leads which might tend to distort their alignment and potentially bend the leads. The sliding engagement with the contacts 20*b* create good electrical connection between the members, causing a cleaning action between the contact fingers and the electrical leads upon each operation of the pushbutton. Although the leads 10*a* extend for a substantial distance, the arrangement of switch contact actuating elements and centralized apertures for the leads cooperate to provide an improved switch having fewer parts which is readily assembled. It is to be understood that the invention as described in the embodiments herein disclosed is susceptible to various modifications without departing from the scope of the appended claims.

We claim:

1. A push-button switch comprising, in combination:

a housing;

switch contacts in said housing;

a pushbutton mounted in said housing for depression inwardly of said housing and having an opening through an outer surface thereof;

means biasing said pushbutton outwardly of said housing;

means operatively connecting said pushbutton and said switch contacts for actuation of said contacts upon depression of said pushbutton;

a lamp mounted in said opening to be visible at the outer surface of said pushbutton and having electrical leads extending through said opening to the interior of said switch housing, said leads being solid conductors extending unsupported from said lamp and parallel to the direction of travel for said pushbutton;

lamp contacts mounted in said housing for resiliently engaging said leads and permitting relative sliding movement between said leads and said lamp contacts; and wherein said housing includes guide means for said leads and said lamp contacts engage said leads on a side opposite said guide means to bias said leads against said guide means.

2. The push-button switch according to claim 1, wherein:

said guide means comprises an upstanding wall portion of said housing extending between said leads.

3. The push-button switch according to claim 2, wherein:

said lamp contacts comprise upstanding portions mounted at one end in said housing and projecting forwardly, and reflex portions projecting toward said leads and in the direction of inward depression of said pushbutton.

4. The push-button switch according to claim 2, wherein:

said means operatively connecting said pushbutton and said switch contacts comprises:

actuator means pivotally mounted in said housing for engagement with said switch contacts;

drive means carried by said pushbutton for engaging said actuator means upon depression of said pushbutton to pivot said actuator, thereby to actuate said switch contacts;

said actuator means and said drive means including clearance openings therethrough for said lamp leads.

5. The push-button switch according to claim 4, wherein:

said lamp, lamp leads and lamp contacts are centrally located around the axial center of said switch.

6. The push-button switch according to claim 4, wherein:

said pushbutton comprises a separate subassembly further comprising:

a molded insulating button element;

a retaining member for snap-in attachment to said button element to permit relative movement between said button and said retaining member, said retaining member further having means for snap-in mounting the pushbutton subassembly in said housing; and said means biasing said pushbutton outwardly of said housing, said biasing means comprising a spring extending between said button element and said retaining member for biasing said button element to an outwardly extended position with respect to said retaining member.

7. The push-button switch according to claim 6, wherein:

said spring is a helical compression spring axially oriented to surround said lamp leads.

8. The push-button switch according to claim 7, wherein:

said drive means comprises a drive pawl positioned for rocking movement in said pushbutton subassembly against an interior surface of said button element, and a helical drive spring extending between said retaining member and said drive pawl to bias said drive pawl against said interior surface of said button element, said drive pawl having a central aperture through which said lamp leads extend and depending arms on opposite sides of said central aperture extending axially along said lamp leads for engagement with said actuator means, said retaining member having a central aperture through which said lamp leads and said arms extend, and said drive spring being axially oriented within said first mentioned spring and surrounding said lamp leads and said arms.

9. The push-button switch according to claim 8, wherein:

said actuator means includes cam surfaces for engaging with said drive pawl arms for pivoting said actuator upon depression of said button element.

10. The push-button switch according to claim 9, wherein:

said drive pawl arms are held out of engagement with said cam surfaces when said button element is in its outwardly extended position.

11. The push-button switch according to claim 10, wherein:

said switch contacts comprise at least one set of three stationary contacts having a bridging contactor rockably supported on the center stationary contact, and said actuator means comprises at least one spring biased plunger in engagement with an upper surface of said contactor, pivotal movement of said actuator causing movement of said plunger along said contactor from one side of said center contact to the other to rock said contactor into bridging engagement with the center contact and either of the outer two stationary contacts.

12. The push-button switch according to claim 11, wherein:

said cam surfaces are W-shaped having a center apex which lie on one side of the pivotal center of said actuator means in response to a first depression of said button and lie on an opposite side of the pivotal center of said actuator means in response to a subsequent depression of said button, thereby to cause said actuator means to pivot in opposite directions upon each successive button depression and to cause said contactor to alternately bridge the respective outer stationary contacts in response to successive button depressions.

13. The push-button switch according to claim 12, wherein:

said bridging contactor is provided with a sloped surface engaged by said spring biased plunger on one side of said center contact whereby said sloped surface and said spring biased plunger cooperate to bias said actuator to return to its original position upon release of said button after each depression, thereby to provide a momentary contact operation for said switch.

14. A push-button switch comprising an operator subassembly and a housing subassembly which are snap-fit together, said operator subassembly comprising:

a button having a central opening extending axially therethrough and depending drive means extending axially on opposite sides of said opening;

a retainer having means for snap-in attachment to said button while permitting relative axial movement between said retainer and said button, said retainer further having means for snap-in mounting in said housing subassembly and a central opening through which said drive means extend;

helical spring means positioned on said retainer to bias said button and said drive means to an outwardly extended position; and a lamp mounted in said opening of said button to be visible to the exterior surface thereof, said lamp having electrical leads extending unsupported therefrom through said helical spring means and said opening in said retainer; and said housing subassembly comprising:

a housing;

switch contacts in said housing;

actuator means in said housing for engagement by said drive means upon depression of said button for actuating said switch contacts, said actuator means having a central opening therethrough; and lamp contacts in said housing for resiliently engaging said lamp leads upon snap-in mounting of said operator subassembly to said housing subassembly for permitting relative axial sliding movement between said lamp leads and said lamp contacts upon depression of said button.

15. The push-button switch according to claim 14, wherein:

said button and said housing are made of electrical insulating material and said button extends inside said housing.

16. The push-button switch according to claim 14, wherein:

said housing includes guide means for said leads and said lamp contacts bias said leads against said guide means.

17. The push-button switch according to claim 16, wherein:

said guide means comprises and upstanding wall of said housing extending between said lamp leads.

* * * * *